US009190250B2

(12) United States Patent
Takeuchi et al.

(10) Patent No.: US 9,190,250 B2
(45) Date of Patent: Nov. 17, 2015

(54) RADIATION MEASUREMENT APPARATUS

(71) Applicant: NIHON DEMPA KOGYO CO., LTD., Tokyo (JP)

(72) Inventors: Toshiaki Takeuchi, Saitama (JP); Kozo Ono, Saitama (JP); Kuichi Kubo, Saitama (JP); Kunio Hamaguchi, Saitama (JP)

(73) Assignee: NIHON DEMPA KOGYO CO., LTD, Tokyo (JP)

( * ) Notice: Subject to any disclaimer, the term of this patent is extended or adjusted under 35 U.S.C. 154(b) by 0 days.

(21) Appl. No.: 14/306,247

(22) Filed: Jun. 17, 2014

(65) Prior Publication Data

US 2015/0008328 A1 Jan. 8, 2015

(30) Foreign Application Priority Data

Jul. 3, 2013 (JP) ..... 2013-139399

(51) Int. Cl.
*H01J 47/00* (2006.01)
*H01J 47/08* (2006.01)

(52) U.S. Cl.
CPC ..... *H01J 47/08* (2013.01)

(58) Field of Classification Search
CPC ..... H01J 47/08; G01T 1/18
USPC ..... 250/385.1
See application file for complete search history.

(56) References Cited

U.S. PATENT DOCUMENTS 2,383,477 A * 8/1945 Friedman ..... 313/93
2,398,934 A * 4/1946 Hare ..... 313/93
3,665,189 A * 5/1972 Maillot ..... 250/385.1
3,951,550 A * 4/1976 Slick ..... 356/141.5
5,274,238 A * 12/1993 Brown ..... 250/394
5,665,970 A * 9/1997 Kronenberg et al. ..... 250/374
5,665,972 A * 9/1997 Dickinson et al. ..... 250/394
6,433,335 B1 * 8/2002 Kronenberg et al. ..... 250/304
6,703,616 B1 * 3/2004 Andersson et al. ..... 250/328
7,863,571 B2 * 1/2011 Beken ..... 250/358.1
2007/0276619 A1 * 11/2007 Sugahara et al. ..... 702/82
2008/0048123 A1 * 2/2008 Larsson et al. ..... 250/363.01
2008/0159476 A1 * 7/2008 Koltick et al. ..... 378/53
2009/0101824 A1 * 4/2009 Beken ..... 250/358.1
2009/0309032 A1 * 12/2009 Ramsden et al. ..... 250/370.1
2013/0187052 A1 * 7/2013 Nelson ..... 250/362

FOREIGN PATENT DOCUMENTS

JP 59-005983 1/1984

* cited by examiner

*Primary Examiner* — Mark R Gaworecki
*Assistant Examiner* — Taeho Jo
(74) *Attorney, Agent, or Firm* — Jianq Chyun IP Office

(57) ABSTRACT

A radiation measurement apparatus for measuring radiation includes a first and second Geiger-Muller counter tubes and a radiation-direction calculating unit. The first Geiger-Muller counter tube seals an electrode within a circular pipe-shaped enclosing tube that extends in a straight line. The first Geiger-Muller counter tube is arranged along a first direction. The second Geiger-Muller counter tube seals an electrode within a circular pipe-shaped enclosing tube that extends in a straight line. The second Geiger-Muller counter tube is arranged in a second direction intersecting with the first direction. The radiation-direction calculating unit is configured to compare a first detection signal and a second detection signal with one another to calculate a direction of radiation to be emitted from the sample. The first detection signal is output from the electrode of the first Geiger-Muller counter tube. The second detection signal is output from the electrode of the second Geiger-Muller counter tube.

2 Claims, 8 Drawing Sheets

RADIATION MEASUREMENT APPARATUS

CROSS-REFERENCE TO RELATED APPLICATIONS

This application claims the priority benefit of Japan application serial no. 2013-139399, filed on Jul. 3, 2013. The entirety of the above-mentioned patent application is hereby incorporated by reference herein and made a part of this specification.

FIELD

This disclosure relates to a radiation measurement apparatus that includes a plurality of Geiger-Muller counter tubes.

DESCRIPTION OF THE RELATED ART

A Geiger-Muller counter tube (GM counter tube) is used in a radiation measurement apparatus for measuring radiation. The GM counter tube includes electrodes formed as an anode and a cathode. In the GM counter tube, inert gas is enclosed. Additionally, between the anode and the cathode of the GM counter tube, a high voltage is applied in use. The radiation that enters into the inside of the GM counter tube ionizes the inert gas into an electron and an ion. The ionized electron and ion are accelerated toward the respective anode and cathode. This causes electrical conduction between the anode and the cathode so as to generate a pulse signal. For example, Japanese Unexamined Patent Application Publication No. 59-5983 (hereinafter referred to as Patent Literature 1) discloses a proportional counter tube for measuring radiation. The proportional counter tube in Patent Literature 1 includes one end from which respective electrode of a cathode and electrode of an anode are extracted.

However, in the proportional counter tube of Patent Literature 1, it is required to further enhance the sensitivity in some cases. Additionally, it is required to accurately figure out the direction from which the radiation is emitted in some cases.

A need thus exists for a radiation measurement apparatus which is not susceptible to the drawback mentioned above.

SUMMARY

According to an aspect, a radiation measurement apparatus for measuring radiation emitted from a sample includes a first Geiger-Muller counter tube, a second Geiger-Muller counter tube, and a radiation-direction calculating unit. The first Geiger-Muller counter tube seals an electrode within a circular pipe-shaped enclosing tube. The enclosing tube extends in a straight line. The first Geiger-Muller counter tube is arranged along a first direction. The second Geiger-Muller counter tube seals an electrode within a circular pipe-shaped enclosing tube. The enclosing tube extends in a straight line. The second Geiger-Muller counter tube is arranged in a second direction intersecting with the first direction. The radiation-direction calculating unit is configured to compare a first detection signal and a second detection signal with one another to calculate a direction of radiation to be emitted from the sample. The first detection signal is output from the electrode of the first Geiger-Muller counter tube. The second detection signal is output from the electrode of the second Geiger-Muller counter tube.

BRIEF DESCRIPTION OF THE DRAWINGS

The foregoing and additional features and characteristics of this disclosure will become more apparent from the following detailed description considered with reference to the accompanying drawings, wherein.

DETAILED DESCRIPTION

The preferred embodiments of this disclosure will be described in detail below with reference to the attached drawings. It will be understood that the scope of the disclosure is not limited to the described embodiments, unless otherwise stated.

Configuration of Radiation Measurement Apparatus 100 of First Embodiment

Figure 1:
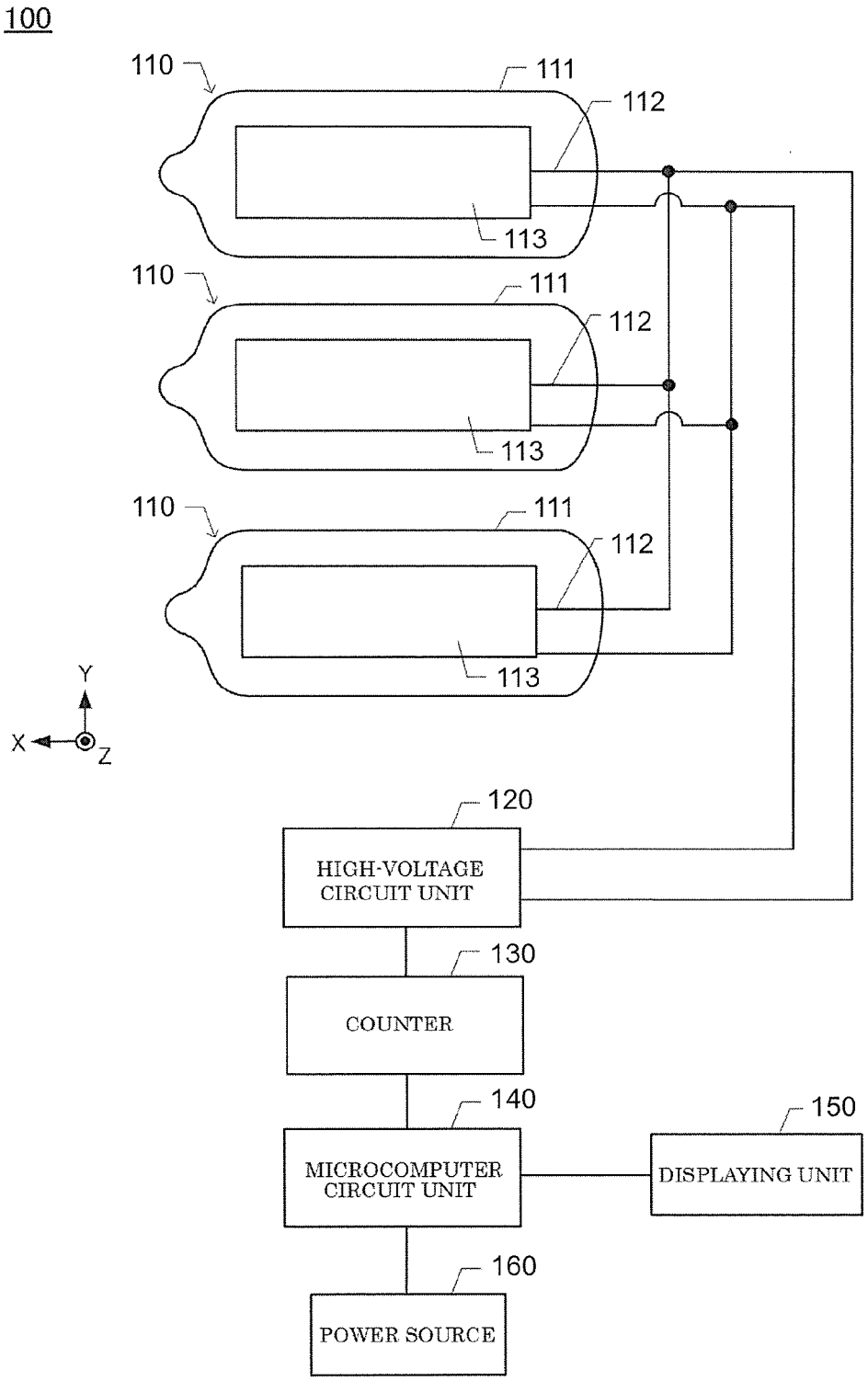
FIG. 1 is a schematic configuration diagram of a radiation measurement apparatus 100.

FIG. 1 is a schematic configuration diagram of a radiation measurement apparatus 100. In the radiation measurement apparatus 100, three Geiger-Muller counter tubes 110 are arranged to be directed to the same direction. Each Geiger-Muller counter tube 110 includes a cylindrical enclosing tube 111, an anode electrode 112, and a cathode electrode 113. The enclosing tube 111 is constituted of glass as a base material. Inside of the enclosing tube 111, the cathode electrode 113 is enclosed. The cathode electrode 113 is formed to surround the rod-shaped anode electrode 112 and the peripheral area of the anode electrode 112. The cathode electrode 113 is constituted of a cylindrical metal pipe. The metal pipe is formed of, for example, metallic Kovar that is an alloy of iron, nickel, and cobalt or stainless steel. The anode electrode 112 is arranged on the central axis of this metal pipe. Accordingly, in the case where a voltage is applied between the cathode electrode 113 and the anode electrode 112, in the cross section along the extending direction of the Geiger-Muller counter tube 110, the electric field of the space surrounded by the cathode electrode 113 is formed with rotational symmetry around the anode electrode 112. Inside of the enclosing tube 111, an inert gas and a quenching gas are enclosed. The inert gas employs noble gas such as helium (He), neon (Ne), and argon (Ar). The quenching gas employs halogen-based gas such as fluorine (F), bromine (Br) and chlorine (Cl).

When the radiation enters into the enclosing tube 111, the radiation ionizes the inert gas into a positively charged ion and a negatively charged electron. Applying a voltage, for example, from 400 to 600 V between the anode electrode 112 and the cathode electrode 113 forms an electric field within the enclosing tube 111. Accordingly, the ionized ion and electron are accelerated toward the respective cathode electrode 113 and anode electrode 112. The accelerated ions collide with another inert gas so as to ionize the other inert gas. This repetition of ionizations forms ionized ions and electrons like an avalanche between the anode electrode 112 and the cathode electrode 113, thus causing a flow of a pulse current. The radiation measurement apparatus with the Geiger-Muller counter tube 110 can measure the number of pulses of a pulse signal due to this pulse current so as to measure the radiation dose. Additionally, when this current continuously flows, the number of pulses cannot be measured. In order to prevent this situation, the quenching gas is enclosed within the enclosing tube 111 together with the inert gas. The quenching gas has an action for dispersing the energy of the ion.

In the radiation measurement apparatus 100, the three Geiger-Muller counter tubes 110 are arranged in parallel to one another. The respective anode electrodes 112 and the respective cathode electrodes 113 of the Geiger-Muller counter tubes 110 are connected in parallel to one another and connected to the high-voltage circuit unit 120. Accordingly, the same high voltage is applied to the respective Geiger-Muller counter tubes 110. The pulse signal detected by the Geiger-Muller counter tube 110 is counted by a counter 130 and then converted into a radiation dose by a microcomputer circuit unit 140. The converted radiation dose is displayed by a displaying unit 150. The microcomputer circuit unit 140 connects to a power source 160 to receive the electric power.

The sensitivity of the radiation measurement apparatus 100 is proportional to the number of pulse signals detected by the Geiger-Muller counter tube 110. The number of pulse signals is proportional to the area of the Geiger-Muller counter tube 110 facing the radiation source. That is, when the normal line of the side surface of the Geiger-Muller counter tube 110 is directed to the direction of the radiation source, the number of pulse signals becomes maximum. For example, in FIG. 1, assume that the extending direction of the respective Geiger-Muller counter tubes 110 of the radiation measurement apparatus 100 is the X-axis direction and the arranging direction of the Geiger-Muller counter tubes 110 is the Y-axis direction. In the case where radiation comes in parallel to the Z-axis, the area of the Geiger-Muller counter tubes 110 facing the radiation source becomes maximum. Accordingly, at this time, the radiation measurement apparatus 100 can detect the most intense signal.

The radiation measurement apparatus 100 includes the three Geiger-Muller counter tubes 110, and thus can detect the pulse signal three times as much as the pulse signal by one Geiger-Muller counter tube. This ensures a higher sensitivity of the radiation measurement apparatus than that of conventional radiation measurement apparatus and allows measurement in a short time in the case where the radiation dose of a sample containing radioactive material or similar sample is measured. Additionally, in the radiation measurement apparatus 100, adjusting the number of the Geiger-Muller counter tubes allows facilitating the adjustment of the sensitivity, which is preferred.

Second Embodiment

In some cases, the radiation measurement apparatus measures air dose of radiation. At this time, it may be required to figure out the direction from which radiation is emitted. The following describes a radiation measurement apparatus 200 that uses a plurality of Geiger-Muller counter tubes to figure out the incoming direction of radiation. Like reference numerals designate corresponding or identical elements throughout the first embodiment, and therefore such elements will not be further elaborated here.

Configuration of Radiation Measurement Apparatus 200

Figure 2:
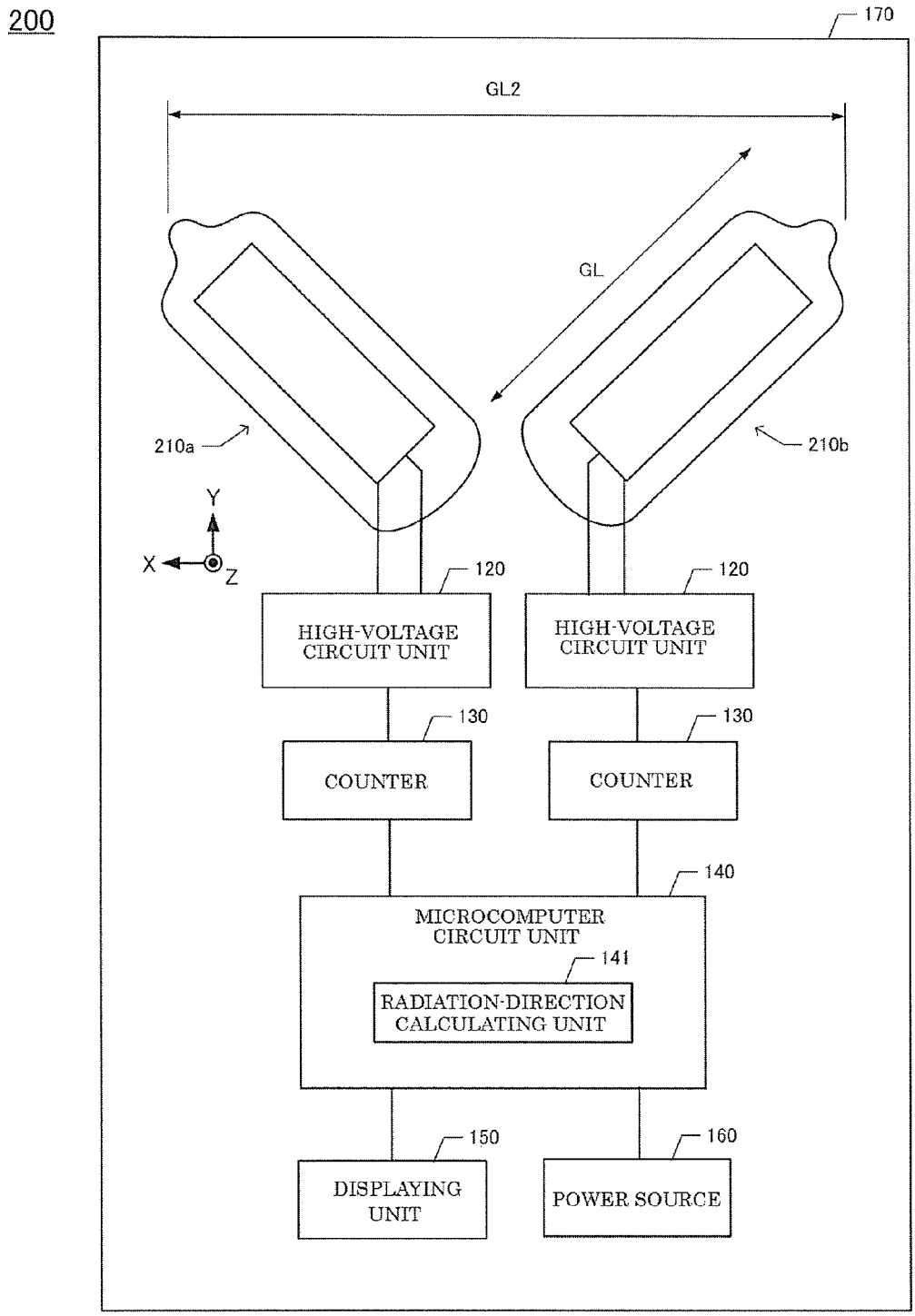
FIG. 2 is a schematic configuration diagram of a radiation measurement apparatus 200.

FIG. 2 is a schematic configuration diagram of the radiation measurement apparatus 200. The radiation measurement apparatus 200 includes a Geiger-Muller counter tube 210*a* and a Geiger-Muller counter tube 210*b*, and these Geiger-Muller counter tubes are housed within a main body 170. In addition to the Geiger-Muller counter tubes, the main body 170 includes the high-voltage circuit units 120, the counters 130, the microcomputer circuit unit 140, the displaying unit 150, and the power source 160. In the following description of the second embodiment, assume that the vertical direction is the Z-axis direction, the direction perpendicular to the Z-axis and along which the Geiger-Muller counter tubes are mounted on the main body 170 is the Y-axis direction, and the direction perpendicular to the Z-axis direction and the Y-axis direction is the X-axis direction.

The Geiger-Muller counter tube 210*a* and the Geiger-Muller counter tube 210*b* are mounted on the main body 170 on the +Y-axis side. In this arrangement, the Geiger-Muller counter tube 210*a* extends in the direction inclined at 45 degrees on the +X-axis side with respect to the Y-axis direction. The Geiger-Muller counter tube 210*b* extends in the direction inclined at 45 degrees on the −X-axis side with respect to the Y-axis direction. That is, the Geiger-Muller counter tube 210*a* and the Geiger-Muller counter tube 210*b* form an angle of 90 degrees. The Geiger-Muller counter tube 210*a* and the Geiger-Muller counter tube 210*b* connect to the respective high-voltage circuit units 120. These high-voltage circuit unit 120 connect to the respective counters 130 to measure the respective numbers of pulse signals in the Geiger-Muller counter tube 210*a* and the Geiger-Muller counter tube 210*b*. The microcomputer circuit unit 140 measures a radiation dose, and a radiation-direction calculating unit 141 arranged in the microcomputer circuit unit 140 calculates the direction from which radiation is emitted. The results from these portions are displayed on the displaying unit 150.

Each length of the Geiger-Muller counter tube 210*a* and the Geiger-Muller counter tube 210*b* is assumed to be a length GL. The entire length of the Geiger-Muller counter tubes in the X-axis direction of the radiation measurement apparatus 200 is assumed to be a length GL2. At this time, the length GL2 is about 1.4 times as long as the length GL. That is, with the radiation measurement apparatus 200, in the case where the radiation emitted from the Y-axis direction is detected, it is possible to obtain the sensitivity about 1.4 times larger than the sensitivity when one of the Geiger-Muller counter tubes is used.

Figure 3A:
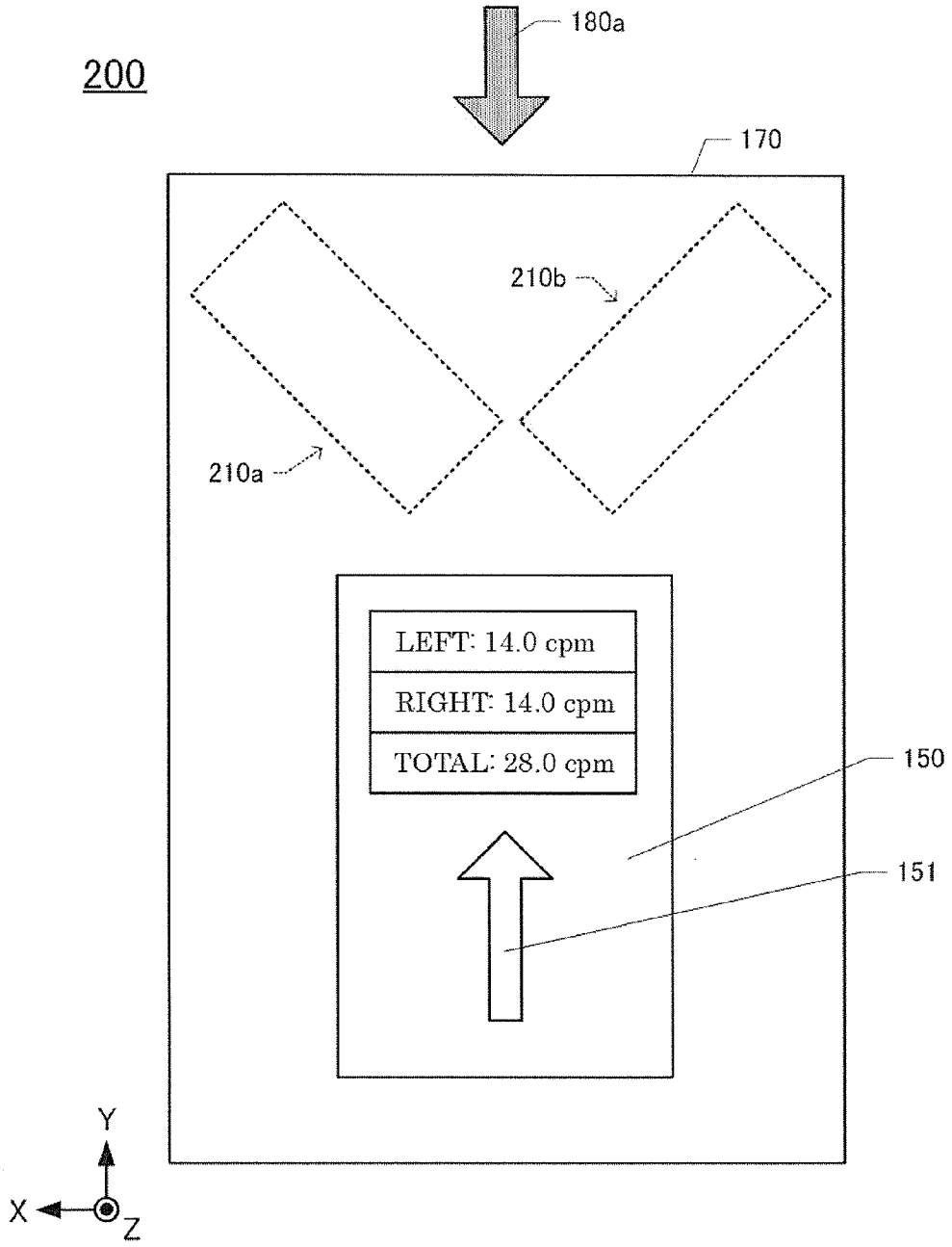
FIG. 3A is a schematic plan view of the radiation measurement apparatus 200 that measures radiation to be emitted from the +Y-axis direction.

FIG. 3A is a schematic plan view of the radiation measurement apparatus 200 that measures the radiation to be emitted from the +Y-axis direction. FIG. 3A illustrates a state where a radiation 180*a* is emitted from the +Y-axis direction. At this time, the Geiger-Muller counter tube 210*a* and the Geiger-Muller counter tube 210*b* are both arranged at the same angle with respect to the radiation 180*a*, and both detect the same amount of radiation. The displaying unit 150 displays, for example, the measured radiation dose and the direction emitted from the radiation.

In the measurement of radiation by the radiation measurement apparatus 200, firstly, the radiation measurement apparatus 200 measures every direction on the XY plane so as to find the direction in which the total radiation becomes comparatively high. Subsequently, the radiation measurement apparatus 200 measures the directions nearby the direction figured out in detail, so as to specify the incoming direction of the radiation. The radiation measurement apparatus 200 might have the same radiation detection amount in the Geiger-Muller counter tube 210*a* and the Geiger-Muller counter tube 210*b* not only regarding the radiation from the +Y-axis direction, but also regarding the radiations incoming from the −Y-axis direction, the +X-axis direction, and the −X-axis direction. However, regarding the radiation from the −Y-axis direction, the measurer of the radiation blocks this radiation. Regarding the radiation from the +X-axis direction or the −X-axis direction, the Geiger-Muller counter tubes block the radiation from each other. Accordingly, the radiation dose becomes highest when the radiation incoming from the +Y-axis direction is measured.

FIG. 3A illustrates the radiation dose of the Geiger-Muller counter tube 210*a* that is the left Geiger-Muller counter tube is 14.0 cpm, the radiation dose of the Geiger-Muller counter tube 210*b* that is the right Geiger-Muller counter tube is 14.0 cpm, and the total radiation dose of the Geiger-Muller counter tube 210*a* and the Geiger-Muller counter tube 210*b* is 28.0 cpm. In the state of FIG. 3A, the same radiation dose is measured by the left and right Geiger-Muller counter tubes. Accordingly, calculation shows that the radiation comes from the +Y-axis direction. Additionally, the incoming direction of the radiation derived from the calculation result is displayed on the displaying unit 150 as an arrow 151. In FIG. 3A, the arrow 151 directed the +Y-axis direction that is the incoming direction of the radiation is displayed.

Figure 3B:
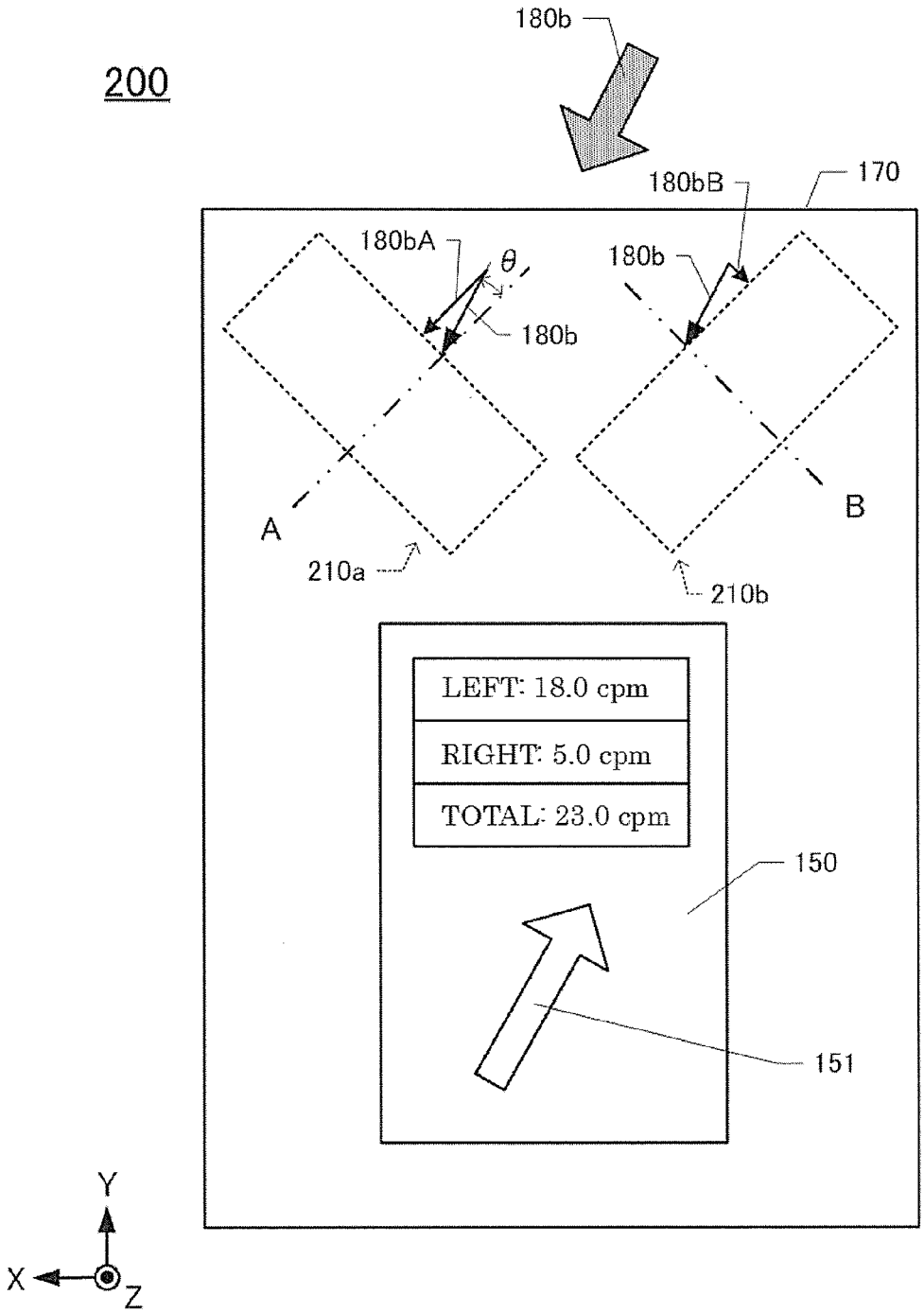
FIG. 3B is a schematic plan view of the radiation measurement apparatus 200 that measures radiation to be emitted from between the +Y-axis direction and the −X-axis direction.

FIG. 3B is a schematic plan view of the radiation measurement apparatus 200 that measures a radiation 180*b* emitted from between the +Y-axis direction and the −X-axis direction. FIG. 3B illustrates a state after the direction in which the summed value of the radiation dose becomes comparatively high has been found. That is, this is the state where the radiation has been found to be emitted from the +Y-axis direction or similar direction. In the case where the radiation 180*b* is emitted from between the +Y-axis direction and the −X-axis direction, the Geiger-Muller counter tube 210*a* has a wider area that receives the radiation compared with the Geiger-Muller counter tube 210*b*, thus having an increased number of detections of the pulse signal. Accordingly, the radiation measurement apparatus 200 estimates that the radiation 180*b* is emitted from the direction between the +Y-axis direction and the −X-axis direction.

The direction from which the radiation 180*b* is emitted can be specified by the respective radiation doses of the Geiger-Muller counter tube 210*a* and the Geiger-Muller counter tube 210*b*. For example, the axis that includes the normal line of the side surface of the Geiger-Muller counter tube 210*a* and is inclined at 45 degrees from the Y-axis toward the −X-axis direction is assumed to be the A-axis. The radiation 180*b* enters into the Geiger-Muller counter tube 210*a* from the direction inclined at an angle θ from the A-axis toward the +X-axis direction. At this time, assuming that the component of the radiation 180*b* in the A-axis direction is a radiation 180*b*A, the radiation 180*b*A has cos θ times the magnitude of the radiation 180*b*. On the other hand, the axis that includes the normal line of the side surface of the Geiger-Muller counter tube 210*b* and is inclined at 45 degrees from the Y-axis toward the +X-axis direction is assumed to be the B-axis. At this time, assuming that the component of the radiation 180*b* in the B-axis direction is a radiation 180*b*B, the radiation 180*b*B has sin θ times the magnitude of the radiation 180*b*. The incoming direction of the radiation 180*b* can be derived from the assumption that the magnitude of the radiation 180*b*A and the magnitude of the radiation 180*b*B correspond to respective radiation doses detected by the Geiger-Muller counter tube 210*a* and the Geiger-Muller counter tube 210*b*.

For example, in FIG. 3B, when 18.0 cpm and 5.0 cpm that are the respective radiation doses detected by the Geiger-Muller counter tube 210*a* and the Geiger-Muller counter tube 210*b* are applied to the magnitude of the radiation 180*b*A and the magnitude of the radiation 180*b*B, the angle θ is calculated as approximately 15.5 degrees. For this calculation, calculation is performed by the radiation-direction calculating unit 141 to calculate the incoming direction of the radiation 180*b* as illustrated in FIG. 3B, so as to display the result as the arrow 151.

Third Embodiment

The radiation measurement apparatus can include three or more of Geiger-Muller counter tubes such that the respective Geiger-Muller counter tubes are arranged to be directed to various directions. The following describes a radiation measurement apparatus 300 and a radiation measurement apparatus 400 that each include three or more Geiger-Muller counter tubes. Like reference numerals designate corresponding or identical elements throughout the first embodiment and the second embodiment, and therefore such elements will not be further elaborated here.

Configuration of Radiation Measurement Apparatus 300

Figure 4A:
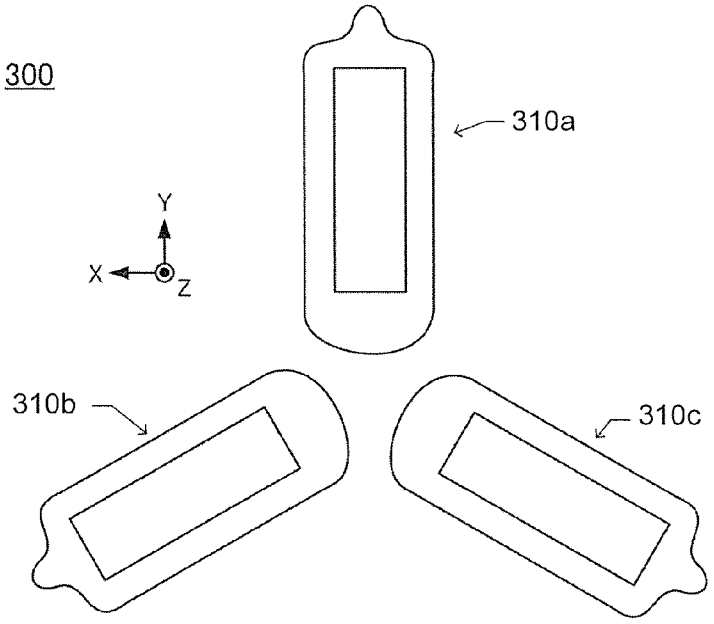
FIG. 4A is a layout of Geiger-Muller counter tubes in a radiation measurement apparatus 300.

FIG. 4A is a layout of the Geiger-Muller counter tubes in the radiation measurement apparatus 300. The radiation measurement apparatus 300 includes three Geiger-Muller counter tubes of a Geiger-Muller counter tube 310*a*, a Geiger-Muller counter tube 310*b*, and a Geiger-Muller counter tube 310*c*. Each Geiger-Muller counter tube is formed in a configuration similar to that of the Geiger-Muller counter tube 110 illustrated in FIG. 1. For example, assume that the Geiger-Muller counter tube 310*a* is arranged to be directed to the Y-axis direction. The Geiger-Muller counter tube 310*b* is arranged to be directed to the direction rotated by 120 degrees toward the +X-axis direction. The Geiger-Muller counter tube 310*c* is arranged to be directed to the direction rotated by 120 degrees toward the −X-axis direction. The radiation measurement apparatus 300 has the highest sensitivity for radiation in the Z-axis direction. The direction of the radiation within the XY plane can be figured out based on the respective radiation doses of the Geiger-Muller counter tubes as illustrated in FIG. 3A and FIG. 3B.

Configuration of Radiation Measurement Apparatus 400

Figure 4B:
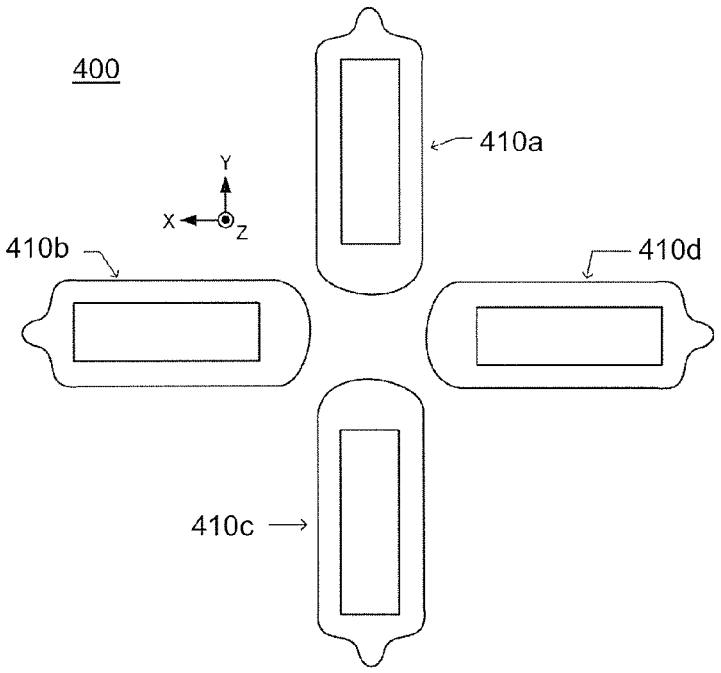
FIG. 4B is a layout of Geiger-Muller counter tubes in a radiation measurement apparatus 400.

FIG. 4B is a layout of the Geiger-Muller counter tubes in the radiation measurement apparatus 400. The radiation measurement apparatus 400 includes four Geiger-Muller counter tubes of a Geiger-Muller counter tube 410*a*, a Geiger-Muller counter tube 410*b*, a Geiger-Muller counter tube 410*c*, and a Geiger-Muller counter tube 410*d*. Each Geiger-Muller counter tube is formed in a configuration similar to that of the Geiger-Muller counter tube 110 illustrated in FIG. 1. For example, the Geiger-Muller counter tube 410*a* is arranged to be directed to the Y-axis direction. The Geiger-Muller counter tube 410*b* is arranged to be directed to the +X-axis direction. The Geiger-Muller counter tube 410*c* is arranged to be directed to the −Y-axis direction. The Geiger-Muller counter tube 410*d* is arranged to be directed to the −X-axis direction. The radiation measurement apparatus 400 has the highest sensitivity for radiation in the Z-axis direction. The direction of the radiation within the XY plane can be figured out based on the respective radiation doses of the Geiger-Muller counter tubes as illustrated in FIG. 3A and FIG. 3B.

Fourth Embodiment

In the radiation measurement apparatus, the Geiger-Muller counter tubes may be arranged to be directed to the respective directions on the three-dimensional coordinate. The following describes a radiation measurement apparatus 500 and a radiation measurement apparatus 600 that each include three-dimensionally arranged Geiger-Muller counter tubes. Like reference numerals designate corresponding or identical elements throughout the first embodiment, the second embodiment, and the third embodiment, and therefore such elements will not be further elaborated here.

Configuration of Radiation Measurement Apparatus 500

Figure 5A:
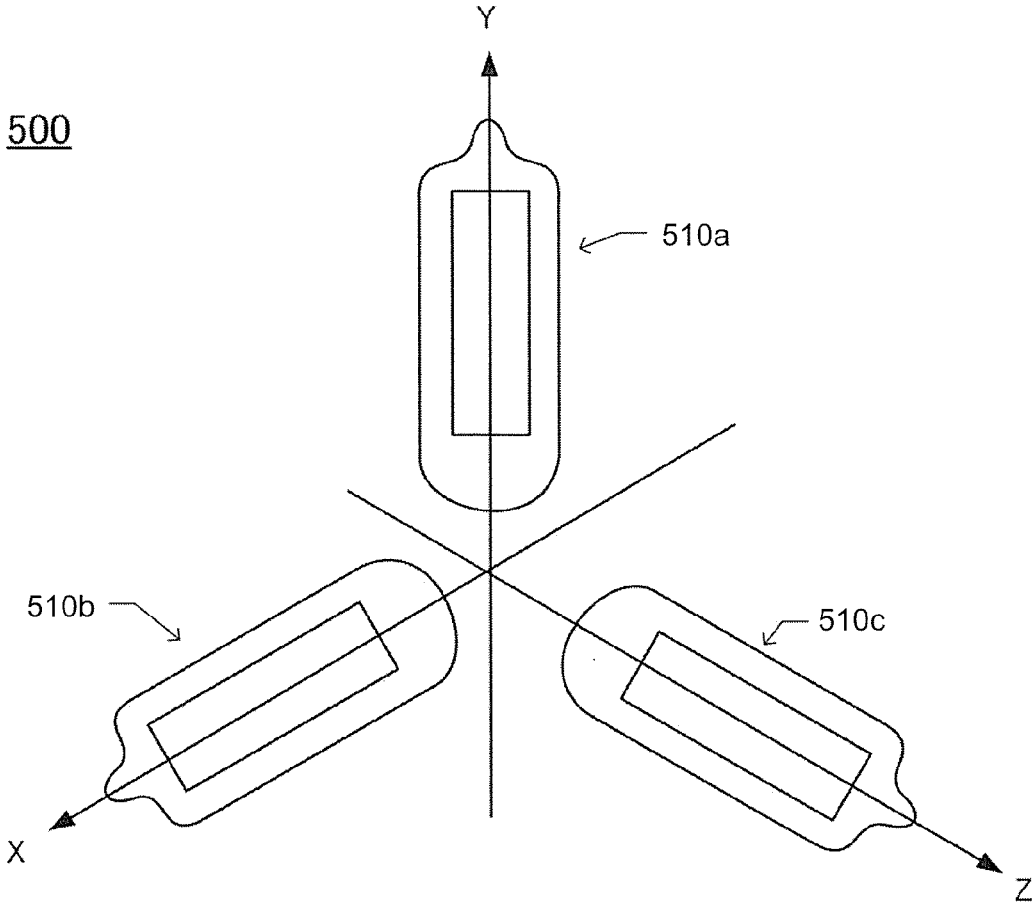
FIG. 5A is a layout of Geiger-Muller counter tubes in a radiation measurement apparatus 500.

FIG. 5A is a layout of the Geiger-Muller counter tubes in the radiation measurement apparatus 500. The radiation measurement apparatus 500 includes three Geiger-Muller counter tubes of a Geiger-Muller counter tube 510*a*, a Geiger-Muller counter tube 510*b*, and a Geiger-Muller counter tube 510*c*. Each Geiger-Muller counter tube is formed in a configuration similar to that of the Geiger-Muller counter tube 110 illustrated in FIG. 1. For example, the respective Geiger-Muller counter tubes are arranged as follows. The Geiger-Muller counter tube 510*a* is arranged to be directed to the Y-axis direction. The Geiger-Muller counter tube 510*b* is arranged to be directed to the +X-axis direction. The Geiger-Muller counter tube 510*c* is arranged to be directed to the +Z-axis direction. In the radiation measurement apparatus 500, similarly to FIG. 3A and FIG. 3B, the direction of the radiation within the three-dimensional space defined by the X-axis, the Y-axis, and the Z-axis can be figured out.

When the direction in the three-dimensional space is specified, for example, the three-dimensional coordinate is displayed on the displaying unit 150 (see FIG. 3A) and the arrow 151 is displayed on the three-dimensional coordinate so as to display the direction in which the arrow 151 is directed.

Configuration of Radiation Measurement Apparatus 600

Figure 5B:
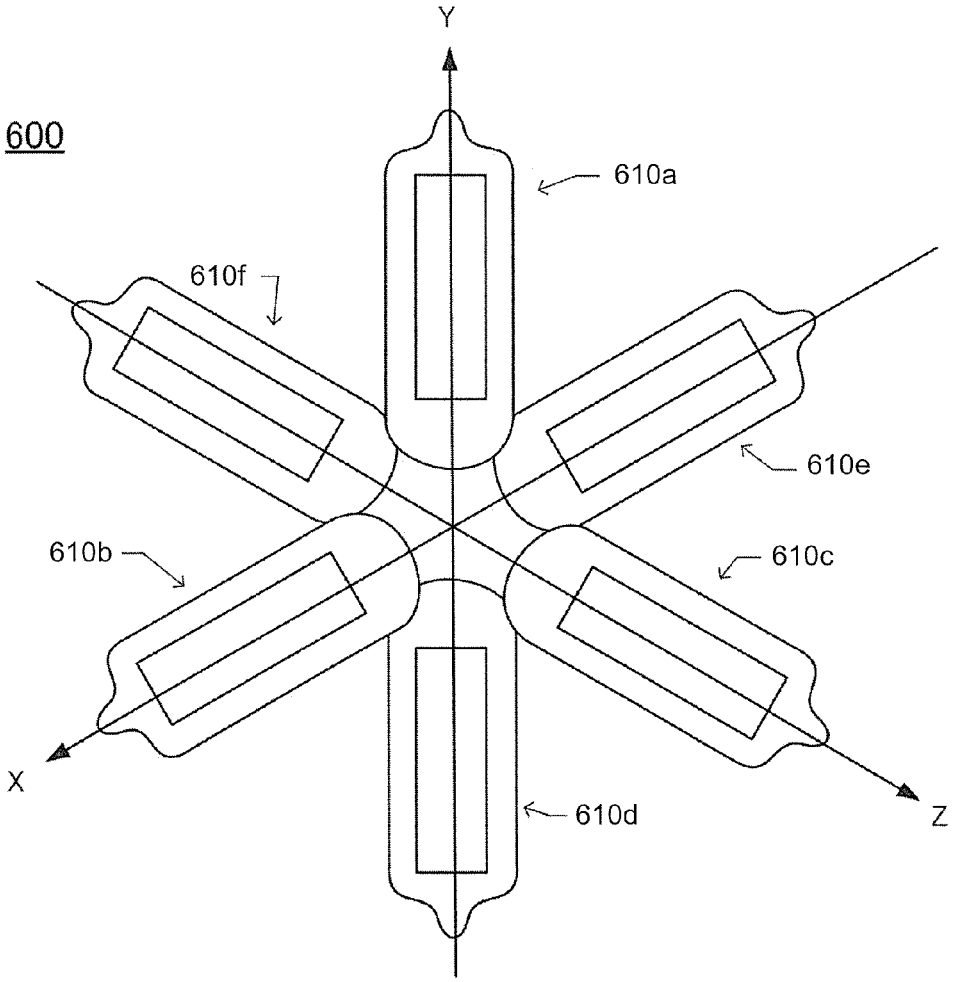
FIG. 5B is a layout of Geiger-Muller counter tubes in a radiation measurement apparatus 600.

FIG. 5B is a layout of the Geiger-Muller counter tubes in the radiation measurement apparatus 600. The radiation measurement apparatus 600 includes six Geiger-Muller counter tubes of a Geiger-Muller counter tube 610*a*, a Geiger-Muller counter tube 610*b*, a Geiger-Muller counter tube 610*c*, a Geiger-Muller counter tube 610*d*, a Geiger-Muller counter tube 610*e*, and a Geiger-Muller counter tube 610*f*. Each Geiger-Muller counter tube is formed in a configuration similar to that of the Geiger-Muller counter tube 110 illustrated in FIG. 1. For example, assume that the Geiger-Muller counter tube 610*a* is arranged to be directed to the +Y-axis direction. The Geiger-Muller counter tube 610*b* is arranged to be directed to the +X-axis direction. The Geiger-Muller counter tube 610*c* is arranged to be directed to the +Z-axis direction. The Geiger-Muller counter tube 610*d* is arranged to be directed to the −Y-axis direction. The Geiger-Muller counter tube 610*e* is arranged to be directed to the −X-axis direction. The Geiger-Muller counter tube 610*f* is arranged to be directed to the −Z-axis direction. In the radiation measurement apparatus 600, the direction of the radiation within the XYZ space can be figured out similarly to FIG. 3A and FIG. 3B. Using the six Geiger-Muller counter tubes allows enhancing the sensitivity.

Fifth Embodiment

The radiation might contain β-ray, γ-ray, and similar ray. The radiation measurement apparatus may be configured to detect radiation for each type of radiation. The following describes a radiation measurement apparatus 700 that detects radiation for each of β-ray and γ-ray. Like reference numerals designate corresponding or identical elements throughout the first embodiment, the second embodiment, the third embodiment, and the fourth embodiment, and therefore such elements will not be further elaborated here.

Configuration of Radiation Measurement Apparatus 700

Figure 6:
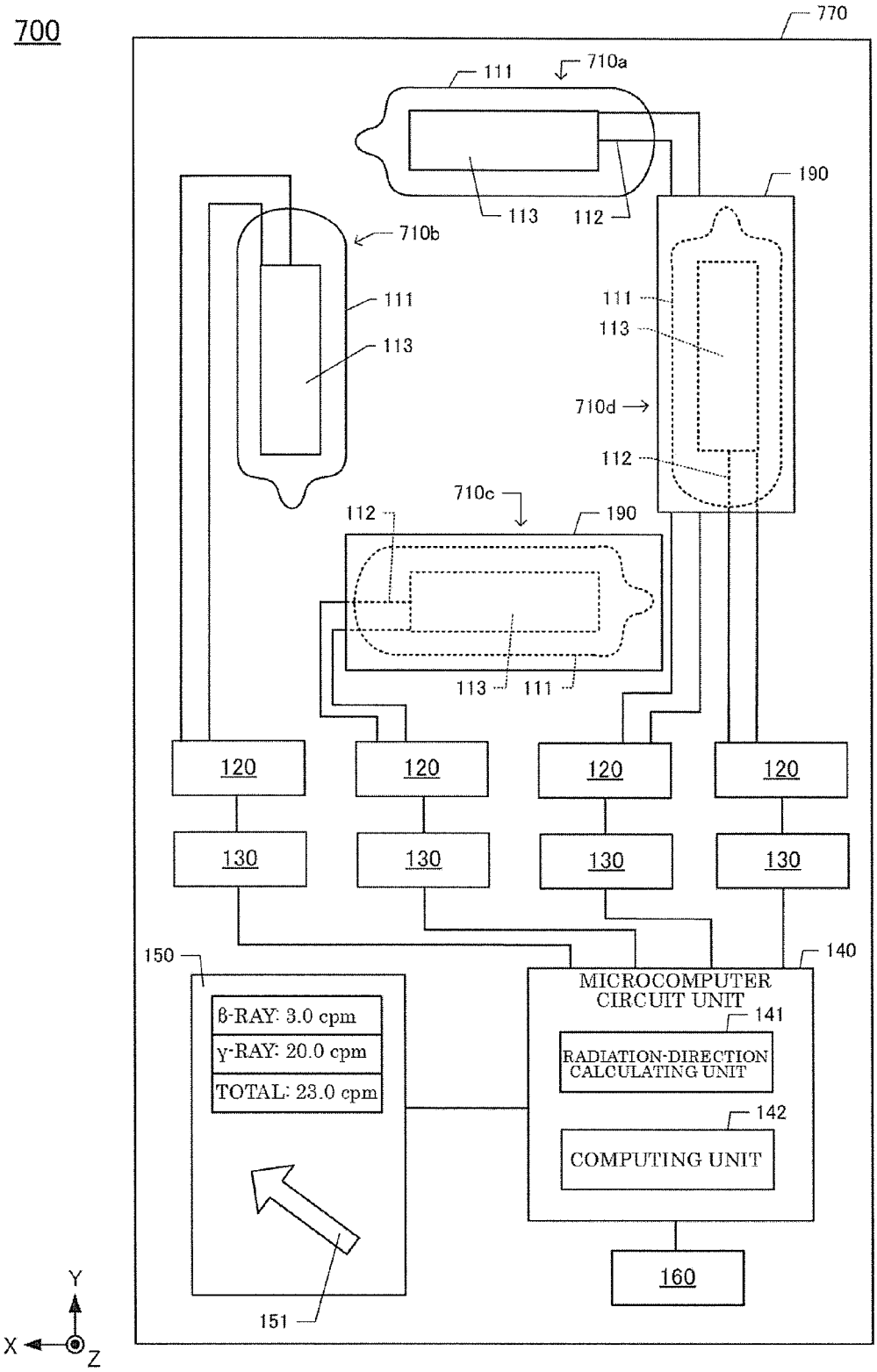
FIG. 6 is a schematic configuration diagram of a radiation measurement apparatus 700.

FIG. 6 is a schematic configuration diagram of the radiation measurement apparatus 700. FIG. 6 illustrates a main body 770, Geiger-Muller counter tubes arranged in the main body 770, the high-voltage circuit units 120, the counters 130, the microcomputer circuit unit 140, the displaying unit 150, and the power source 160. The radiation measurement apparatus 700 includes four Geiger-Muller counter tubes of a Geiger-Muller counter tube 710*a*, a Geiger-Muller counter tube 710*b*, a Geiger-Muller counter tube 710*c*, and a Geiger-Muller counter tube 710*d*. The Geiger-Muller counter tube 710*a* is arranged to be directed to the +X-axis direction. The Geiger-Muller counter tube 710*b* is arranged to be directed to the −Y-axis direction. The Geiger-Muller counter tube 710*c* is arranged to be directed to the −X-axis direction. The Geiger-Muller counter tube 710*d* is arranged to be directed to the +Y-axis direction. That is, the Geiger-Muller counter tube 710*a* and the Geiger-Muller counter tube 710*c* are arranged in parallel to each other. The Geiger-Muller counter tube 710*b* and the Geiger-Muller counter tube 710*d* are arranged in parallel to each other. Each Geiger-Muller counter tube is formed of the enclosing tube 111, the anode electrode 112, and the cathode electrode 113, similarly to the Geiger-Muller counter tube 110 illustrated in FIG. 1. In the Geiger-Muller counter tube 710*c* and the Geiger-Muller counter tube 710*d*, the enclosing tube 111 is housed in a casing 190 formed of aluminum.

Each Geiger-Muller counter tube connects to the corresponding high-voltage circuit unit 120 and further connects to the corresponding counter 130. The respective counters 130 connect to the microcomputer circuit unit 140. The microcomputer circuit unit 140 calculates the radiation doses measured by the respective Geiger-Muller counter tube. The microcomputer circuit unit 140 includes the radiation-direction calculating unit 141 and a computing unit 142. The radiation-direction calculating unit 141 calculates the incoming direction of the radiation. The computing unit 142 computes the respective amounts of β-ray and γ-ray contained in the radiation. These calculation results are displayed on the displaying unit 150. The power source 160 supplies electric power to the microcomputer circuit unit 140.

The radiation might contain a plurality of radioactive rays such as α (alpha) ray, β (beta) ray, and γ (gamma) ray. The penetrating power of α-ray is low, and β-ray is shielded by aluminum or similar material. In contrast, γ-ray has a high penetrating power and a high scattering capacity for long distance. Therefore, while γ-ray is measured for measuring the air dose of radiation, the dose of γ-ray cannot be accurately measured in the case where the radiation contains α-ray and β-ray. In the radiation measurement apparatus 700, the Geiger-Muller counter tube 710*c* and the Geiger-Muller counter tube 710*d* are each covered with the casing 190 so as to shield α-ray and β-ray. Accordingly, the Geiger-Muller counter tube 710*c* and the Geiger-Muller counter tube 710*d* can detect and measure γ-ray alone. Additionally, the difference in radiation dose between the Geiger-Muller counter tube 710*a* and the Geiger-Muller counter tube 710*c* and the difference in radiation dose between the Geiger-Muller counter tube 710*b* and the Geiger-Muller counter tube 710*d* are calculated so as to figure out how much amount of α-ray, β-ray, and γ-ray in total the radiation contains. Here, α-ray has a low penetrating power and a low scattering capacity for long distance. In the case where the air dose of radiation is measured without radioactive substance in the peripheral area, it may be considered that there is very little α-ray. Accordingly, the computing unit 142 of the radiation measurement apparatus 700 computes the respective amounts of β-ray and γ-ray.

The radiation measurement apparatus 700 can cause the displaying unit 150 to display the respective radiation doses of β-ray and γ-ray calculated by the computing unit 142. In FIG. 6, the respective radiation doses of β-ray and γ-ray are displayed and the total radiation dose is displayed. Additionally, the direction from which the radiation is emitted is displayed by the arrow 151.

While in the radiation measurement apparatus 700 the casing 190 prevents α-ray and β-ray in the Geiger-Muller counter tube 710*e* and the Geiger-Muller counter tube 710*d*, for example, α-ray and β-ray may be prevented by arranging an aluminum sheet or forming an aluminum film in the enclosing tube 111.

According to a second aspect, in the first aspect, the radiation measurement apparatus further includes a third Geiger-Muller counter tube. The third Geiger-Muller counter tube seals an electrode within a circular pipe-shaped enclosing tube. The enclosing tube extends in a straight line. The third Geiger-Muller counter tube is arranged along a third direction perpendicular to the first direction and the second direction. The radiation-direction calculating unit is configured to compare a third detection signal, the first detection signal, and the second detection signal with one another. The third detection signal is output from the electrode of the third Geiger-Muller counter tube.

According to a third aspect, in the first aspect, the radiation measurement apparatus further includes a third Geiger-Muller counter tube. The third Geiger-Muller counter tube seals an electrode within a circular pipe-shaped enclosing tube. The enclosing tube extends in a straight line. The third Geiger-Muller counter tube is arranged along a third direction. The third direction intersects with the first direction and the second direction on a same plane of the first direction and the second direction. The radiation-direction calculating unit is configured to compare a third detection signal, the first detection signal, and the second detection signal with one another. The third detection signal is output from the electrode of the third Geiger-Muller counter tube.

According to a fourth aspect, in the first aspect, the radiation measurement apparatus further includes a third Geiger-Muller counter tube and a fourth Geiger-Muller counter tube. The third Geiger-Muller counter tube seals an electrode within a circular pipe-shaped enclosing tube. The enclosing tube extends in a straight line. The third Geiger-Muller counter tube is arranged in parallel to the first Geiger-Muller counter tube along the first direction. The fourth Geiger-Muller counter tube seals an electrode within a circular pipe-shaped enclosing tube. The enclosing tube extends in a straight line. The fourth Geiger-Muller counter tube is arranged in parallel to the second Geiger-Muller counter tube along the second direction. The radiation-direction calculating unit is configured to compare a third detection signal, a fourth detection signal, the first detection signal, and the second detection signal with one another. The third detection signal is output from the electrode of the third Geiger-Muller counter tube. The fourth detection signal is output from the electrode of the fourth Geiger-Muller counter tube.

According to a fifth aspect, in the second aspect or the third aspect, the radiation measurement apparatus further includes a fourth Geiger-Muller counter tube and a computing unit. In the fourth Geiger-Muller counter tube, one of an inside of an enclosing tube and an outside of the enclosing tube is covered with a metal film. The metal film shields beta ray. The first Geiger-Muller counter tube and the second Geiger-Muller counter tube are each configured to detect beta ray and gamma ray to be emitted from the sample. The fourth Geiger-Muller counter tube is configured to detect the gamma ray to be emitted from the sample. The computing unit is configured to compute respective amounts of the beta ray and the gamma ray based on the first detection signal, the second detection signal, and a fourth detection signal. The fourth detection signal is output from an electrode of the fourth Geiger-Muller counter tube.

According to a six aspect, in the first aspect to the fifth aspect, the radiation measurement apparatus further includes a displaying unit configured to display a direction of radiation to be emitted from the sample based on a calculation result of the radiation-direction calculating unit.

The radiation measurement apparatus according to this disclosure allows improving the sensitivity for measuring radiation and figuring out the direction from which the radiation is emitted.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A radiation measurement apparatus for measuring radiation emitted from a sample, comprising:

a first Geiger-Muller counter tube that seals an electrode within a circular pipe-shaped enclosing tube, the enclosing tube extending in a straight line, the first Geiger-Muller counter tube being arranged along a first direction;

a second Geiger-Muller counter tube that seals an electrode within a circular pipe-shaped enclosing tube, the enclosing tube extending in a straight line, the second Geiger-Muller counter tube being arranged in a second direction intersecting with the first direction;

a radiation-direction calculating unit configured to compare a first detection signal and a second detection signal with one another to calculate a direction of radiation to be emitted from the sample, the first detection signal being output from the electrode of the first Geiger-Muller counter tube, the second detection signal being output from the electrode of the second Geiger-Muller counter tube;

a third Geiger-Muller counter tube that seals an electrode within a circular pipe-shaped enclosing tube, the enclosing tube extending in a straight line, the third Geiger-Muller counter tube being arranged along a third direction perpendicular to the first direction and the second direction, wherein the radiation-direction calculating unit is configured to compare a third detection signal, the first detection signal, and the second detection signal with one another, the third detection signal being output from the electrode of the third Geiger-Muller counter tube;

a fourth Geiger-Muller counter tube that seals an electrode within an enclosing tube, one of an inside of the enclosing tube and an outside of the enclosing tube being covered with a metal film, the metal film shielding beta ray; and a computing unit, wherein the first Geiger-Muller counter tube and the second Geiger-Muller counter tube are each configured to detect beta ray and gamma ray to be emitted from the sample, the fourth Geiger-Muller counter tube is configured to detect the gamma ray to be emitted from the sample, and the computing unit is configured to compute respective amounts of the beta ray and the gamma ray based on the first detection signal, the second detection signal, and a fourth detection signal, the fourth detection signal being output from the electrode of the fourth Geiger-Muller counter tube.

2. The radiation measurement apparatus according to claim 1, further comprising a displaying unit configured to display a direction of radiation to be emitted from the sample based on a calculation result of the radiation-direction calculating unit.

* * * * *